United States Patent [19]

Derr et al.

[11] Patent Number: 4,974,383

[45] Date of Patent: Dec. 4, 1990

[54] SANDWICH PANEL

[75] Inventors: Dennis E. Derr, Macungie; Ernest N. Litzenberger, Boyertown, both of Pa.

[73] Assignee: Bally Engineered Structures, Inc., Bally, Pa.

[21] Appl. No.: 337,771

[22] Filed: Apr. 13, 1989

[51] Int. Cl.[5] ..... E04B 2/32

[52] U.S. Cl. ..... 52/582; 52/284

[58] Field of Search ..... 52/309.9, 309.7, 309.16, 52/595, 802, 582, 284; 228/222

[56] References Cited

U.S. PATENT DOCUMENTS

| | | | |
|---|---|---|---|
| 1,270,045 | 6/1918 | Murray . | |
| 1,902,051 | 3/1933 | Wall . | |
| 2,357,170 | 8/1944 | Burggraf | 219/17 |
| 3,012,130 | 12/1961 | Harrison | 219/137 |
| 3,307,013 | 2/1967 | Pratt | 219/136 |
| 3,358,751 | 12/1967 | Berwald et al. | 165/185 |
| 3,372,852 | 3/1968 | Cornell | 228/50 |
| 3,412,457 | 11/1968 | Gregory | 29/487 |
| 3,463,526 | 8/1969 | Benincasa et al. | 289/189 |
| 3,494,020 | 2/1970 | Cornell | 29/491 |
| 3,769,963 | 9/1988 | Meyerson | 52/309.9 |
| 3,791,912 | 2/1974 | Allard | 52/309.9 |
| 4,101,067 | 7/1978 | Sloan et al. | 228/222 |
| 4,296,300 | 10/1981 | Bottiglia | 219/61 |
| 4,557,091 | 12/1985 | Auer | 52/595 |

*Primary Examiner*—David A. Scherbel

*Assistant Examiner*—Michele A. Van Patten

*Attorney, Agent, or Firm*—Parmelee, Miller, Welsh & Kratz

[57] ABSTRACT

Walk-in coolers for maintaining a chamber at a temperature are assembled from sandwich panels, which are welded together in end-to-end abutting relationship. Each panel generally has an inner metallic facing and a spaced opposed metallic facing with the space between the facings filled with a thermal insulating organic material having a coefficient of thermal conductivity of less than 0.3 Btu/hr,ft$^2$,°F./ft. The abutting ends of the inner facings are welded together to cover the crevices between the inner facings and to fill the corners between mutually perpendicular facings. A heat conducting member having a coefficient of thermal conductivity greater than about 0.3 Btu/hr,ft$^2$,°F./ft is disposed in the insulating material in contact with the inner facing adjacent the welded abutting end. The head conducting member transfers heat from the weld zone during welding to limit the temperature of the facing and retransfers the heat back to the weld zone at a lower temperature as the weld cools to ambient temperatures and simultaneously protects against the delamination of the facing from the insulating material also the burning of the insulating material. Where the heat conducting members are fixed to the inner facing, the inner facing is protected from warping by the heat conducting members.

16 Claims, 2 Drawing Sheets

SANDWICH PANEL

This invention relates to sandwich panels of the type which are assembled to form the ceilings, walls and floors of walk-in coolers and similar structures for maintaining a chamber defined by the assembly at a low temperature.

Sandwich panels generally comprise a pair of spaced apart metallic facings with a thermal insulating organic material having a coefficient of thermal conductivity of less than about 0.3 Btu/hr,ft$^2$,° F./ft disposed throughout the space between the facings. See, e.g., the June 1977 Adhesives Age magazine at pages 23–28 for a general discussion by Christian Strobech of sandwich panels, their manufacture and use, which incorporated by this reference. Commercially available panels come in sizes of up to about four feet wide by twenty-eight feet long, depending upon the thermal design, and are available thicknesses up to about eight inches. Thus the panels are frequently assembled at a job site.

The inner facing members of assemblies employed in food processing applications are usually welded together to cover the crevices between adjacent facing members and to fill the corners between adjacent perpendicular facing members. This prevents the later growth of bacteria associated with food processing, such as listeria and salmonella, in the crevices and corners which are difficult to keep clean. The welds also seal the inner facings against the in-leakage of steam and sanitization solutions into the panels during routine cleaning.

Welding, and especially field welding, two large sandwich panel facings exposes their ends to potentially high temperatures which may warp the facings, delaminate the insulation, cause blow holes, or, in the worst case, burn away the insulation. Such panels will not likely be commercially acceptable in the food processing applications for which they were specified.

Sandwich panels embodying the present invention are welded together without exposing the facing members or the insulation to damaging high temperatures or thermally induced forces. An improved sandwich panel has a pair of opposed spaced apart facing members with the space between them generally filled with a suitable thermal insulating organic material. At least one of the facing members has ends which are adapted to be welded to the ends of other sandwich panels in an assembly defining a chamber. Heat conducting members are disposed within the insulating material in contact with the facing member to be welded adjacent the length of its ends to be welded. The heat conducting member has a coefficient of thermal conductivity greater than 0.3 Btu/hr,ft$^2$,° F./ft. In addition the heat conducting members may also be welded to the facing members for preventing warping during welding.

Other objects, details and advantages of the invention will become apparent as the following description of a presently preferred embodiment of the invention preceeds.

The accompanying drawings show a presently preferred embodiment of the invention in which.

Figure 1:
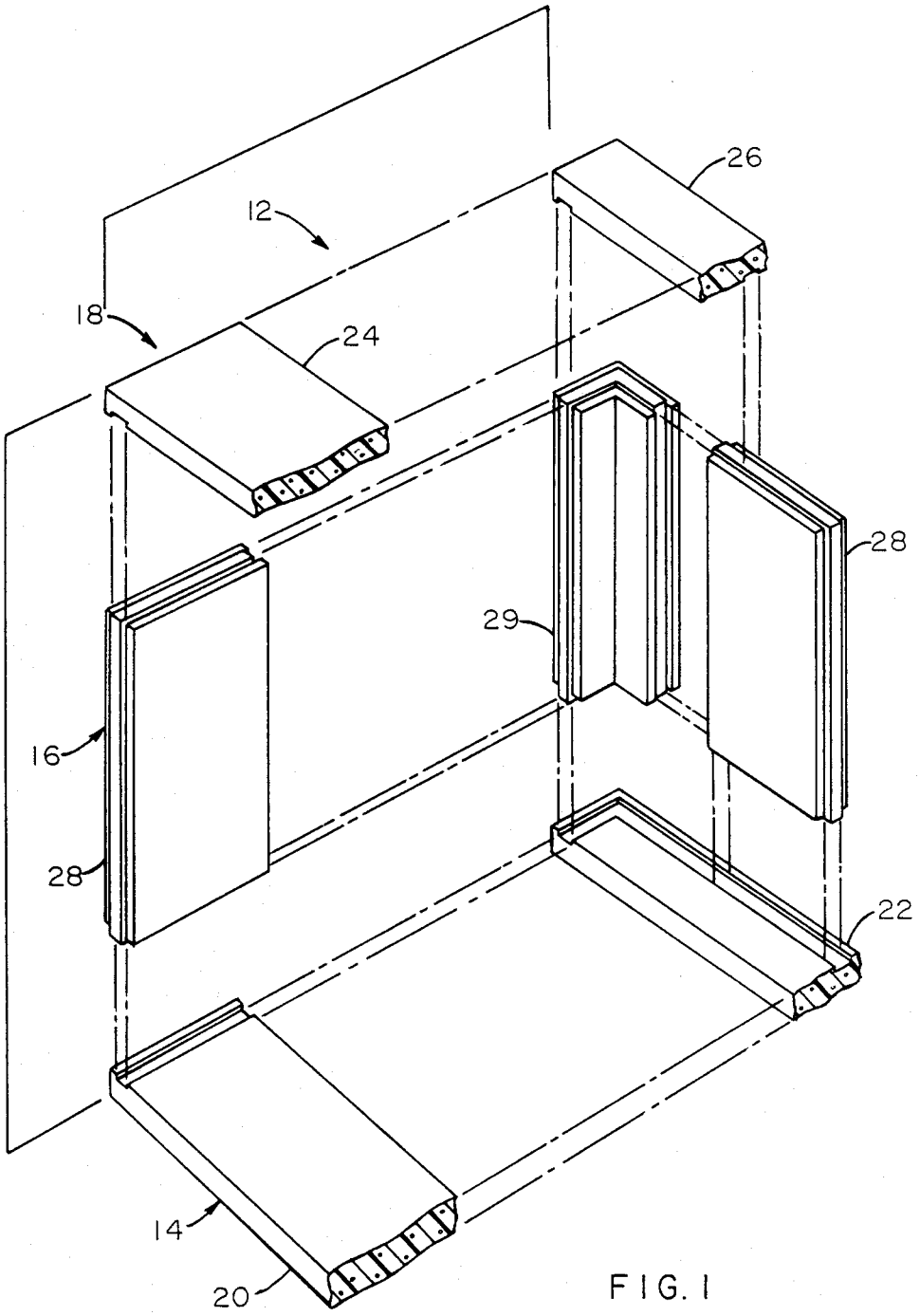
FIG. 1 is an exploded fragmentary perspective schematic view of an interior corner of an assembly comprised of several sandwich panels in which the present invention may be usefully employed.

FIG. 1 generally shows an interior section of an assembly such as a walk-in cooler 12 generally having a floor 14, walls 16 and a ceiling 18. The floor 14 and roof 18 are generally formed by a plurality of horizontal panels 20,22 and 24,26 respectively. Similarly the walls 16 are qenerally formed by a plurality of vertical wall panels 28 and vertical corner panels, such as the corner panel 29 shown. The assembly may also comprise suitably located doors, partitions, inter-panel locking devices and other hardware (not shown).

Figure 2:
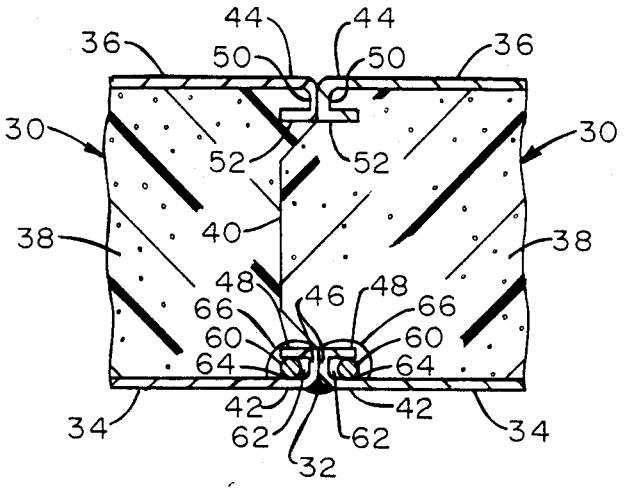
FIG. 2 is fragmentary cross sectional view of the abutting ends of two parallel sandwich panels which illustrate a preferred embodiment of the present invention.

FIG. 2 generally shows two abutting parallel sandwich panels 30 which are welded toqether by a weld 32 to form a continuous surface generally defined by the weld 32 and the adjacent inner facing members 34. The wall and corner panels 28,29 shown in FIG. 1 may similarly be welded to form a continuous vertical wall. Also, the floor panels 20,22 and the ceiling panels 24,26 may be welded to form a continuous floor 14 and ceiling 18, respectively. Each inner facing member 34 is spaced from an opposing facing member 36 by a distance which may vary between about one inch to about eight inches or more. The facing members 34,36 are generally stainless steel in thickness of up to about 14 gauge (0.0776 inches) in the case of floor panels and are preferably a weldable grade of Type 301 stainless steel in most applications. The facing members may also be galvanized steel or aluminum.

The space between the facing members 34,36 is generally filled with a suitable thermal insulating organic material 38 such as polyurethane, polystyrene, acrylonitrilestyrene, polyisocyanurate or polyvinylchloride foam. The foam may be provided in the form of preformed boards, but is preferably foamed-in-place in accordance with well known industry practices. In addition the insulating material may contain glass fibers or other reinforcing materials, flame retardants, antioxidants, blowing agents and other known additives. Such thermal insulating materials have coefficients of thermal conductivity of less than about 0.3 Btu/hr,ft$^2$, ° F./ft. Also, these foams are normally adhesively bonded to the facing members. The Adhesives Age article by Strobech may be consulted for its discussion of insulating materials and adhesives.

As shown in FIG. 2, the facing members 34,36 are preferrably adapted to form a tongue-and-groove joint 40 with abutting inner facing member ends 42 and abutting spaced opposing facing member ends 44. Preferably distal portions 46 of the inner facing member ends 42 extend toward the spaced opposed facing member 36 and these portions 46 are locked into abutting relation with the distal portions 46 of the adjacent inner facing members 34 when a structure such as the walk-in cooler 12 is assembled. Also, the distal end portions 46 may have return bends 48 which tend to anchor the insulation 38. Similarly the ends 44 of the spaced opposed facing members 36 have distal end portions 50 with return bends 52 which perform the same function.

The ends 42 of the inner facing members 34 are adapted to be welded together by the weld 32. Thus the ends 42 must be sufficiently close to each other that a continuous surface may be formed over the crevises between them. The weld 32 is preferably put down with a constant current AC/DC tungsten inert gas unit for introducing maximum controllable heat into the work.

The above discussed structure generally describes sandwich panels and assemblies with which the present invention may be advantageously employed. The sandwich panels of the present invention have heat conducting members 60 disposed in the insulating material adjacent to the ends 42 to be welded. The heat conducting members 60 contact the facing members 34 preferably along their entire length and have a coefficient of thermal conductivity which is greater than about 0.3 Btu/hr,ft$^2$, ° F./ft. Accordingly, the heat conducting member may be comprised of a metallic, ceramic or other heat conducting material.

As shown in FIG. 2, the heat conducting members 60 may have a circular cross section. Such a configuration will generally contact the inner facing members 34 adjacent the ends 42 and their distal portions 46 (usually at the return bends 48) along two lines such that the portion of peripheral surfaces of the conducting members between the two lines and the confronting surfaces of the inner facing members 34 define passageways 62 disposed opposite the weld 32. These passageways are generally filled with (although other gases may be employed) which advantageously tends to insulate the organic material 38 from the back of the weld 32 during assembly and permits higher local temperatures in the weld zone. Alternatively, the heat conducting members 60 could be in continuous contact with the portions of the inner facing 38 opposite the weld 32. Thus, e.g., the heat conducting members could alternatively have a rectangular cross section and abut the distal end portions 46.

The heat conducting members, such as the cylindrical member 60 of FIG. 2, are preferably metallic and have a thickness at least about the thickness of the facing members 34 to which they ar attached. The heat conducting members 60 are themselves preferably welded to the ends 42 of the inner facing members 34 with welds 64 such that the welds 32 between sandwich panels 30 are disposed between the welds 64 and the distal end portions 46. This structure advantageously reinforces the inner facing members 34 from warping when weld 32 is put down. Also, the heat conducting means 60 may advantageously urge the abutting end portions 46 together during welding where the heat conducting means 60 themselves abut the distal end portions 46 adjacent the weld zone. In addition, the heat conducting members 60 are preferably not welded to the distal end portions 46 so that relative thermal expansion induced by welding can be tolerated. The heat conducting members 60 may be tack welded to the inner facing members 34 although more costly continuous welds would be more thermally efficient. A steel facing member 34 having a thickness of up to about 0.0368 inches and a 0.375 inch diameter heat conducting member 60 (which is a thickness ratio of 10/1) provides a suitable heat sink which also reinforces the facing member 34 against warping. The thickness of the facing member 34 will vary according to the structural design of the panel and may in some cases be relatively thinner where all of its ends are reinforced by heat conducting members 60.

The heat conducting members 60 and the return bends 48 may be coated with silicone rubber material 66 or other suitable coating for protecting particularly temperature sensitive insulating materials and adhesives from high temperature spikes during welding. Also the coating tolerates relative thermal expansion of the heat conducting members 60 and return bends 48 relative to the insulating material 38 without delaminating the insulating material 38.

Figure 3:
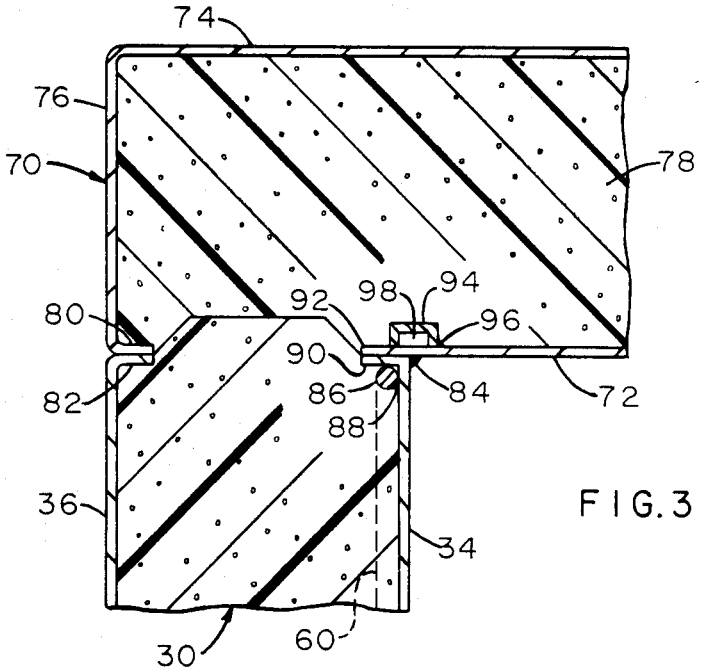
FIG. 3 is a fraqmentary cross sectional view of the abutting ends of two perpendicular sandwich panels, which illustrates a second preferred embodiment of the present invention.

FIG. 3 generally shows two abutting perpendicular sandwich panels, including a vertical panel 30 of FIG. 2 and a horizontal panel 70, which may be e.g., a floor panel 20 or a ceiling panel 24 of FIG. 1. The horizontal sandwich panel 70 generally has an inner facing member 72 and a spaced opposing facing member 74 which has a transverse portion 76 extending around the thermal insulating organic material 78 to a distal end portion 80 which abuts the distal end portion 82 of the opposing facing member 74. A weld 84 deposited in the corner defined by the inner facing members 34, 72 seals the facing members 34, 72 together.

The vertical panel 30 has a cylindrical heat conducting member 86 attached to the inner facing member 34 by a weld such as tack weld 88. The heat conducting member 86 is preferably in slidable contact with the distal end portion 90 of the inner facing member 34. The cylindrical heat conducting member 60 shown in FIG. 2 discussed above is shown in FIG. 3 in chain to illustrate the relative position of two adjacent heat conducting members 60,86 in a sandwich panel, one of which may be adjacent a corner. In addition to being welded, the heat conducting members 60, 86 may alternatively be adhesively bonded to the inner facing members 34 or may be crimped in place by distal end portions 46, 90, respectively, or clamped in place.

The horizontal panel 70 has an inner facing member 72 with a distal end portion 92 extending toward the spaced apart distal end 80 of opposed facing member 74, which end portion 92 is in contact with insulating material 78 and abuts the distal end portion 90 of inner facing member 34. A rectangular heat conducting member 94 is attached to the inner facing member 72 by weld 96 such that the heat conducting member 94 is portion of the inner facing member 72 adjacent the weld 84 for protecting the insulating material and preventing warping during welding while permitting the weld zone to reach high local temperatures. Alternatively, other shaped members having at least one flat surface may be used in place of a rectangular member. Also, a generally rectangular shaped heat conducting member may (as shown) have a recess 98 for providing a passageway opposite the weld. In addition the heat conducting member could be adhesively attached to inner facing member, but this means of attachment may not satisfactorily prevent warping in some cases. Also the heat conducting members and distal end portions may have silicone coatings (not shown) for protecting the insulating material and for facilitating relative thermal movement.

Sandwich panels comprising the above described heat conducting members may be field welded to form walk-ins and other structures with the generation of lower smoke levels than are realized where the insulating material chars or is burned away during welding.

While a preferred embodiment of the present invention has been shown and described, it is to be distinctly understood that the present invention is not limited thereto, but may be otherwise variously embodied within the scope of the following claims.

What is claimed is:

1. A sandwich panel having a pair of spaced apart metallic facing members, including an inner facing member and an opposed facing member, defining a space with the space between the facing members being generally filled with a thermal insulating organic material having a thermal conductivity of less than about 0.3 Btu/hr, ft$^2$, ° F./ft, the inner facing member having ends with welds deposited thereon; the sandwich panel further comprising:

heat conducting members contacting the inner facing member adjacent the length of the welded ends, the heat conducting members disposed within the insulating material and having a thermal conductivity greater than about 0.3 Btu/hr, ft$^2$,° F./ft.

2. The sandwich panel of claim 1, wherein the heat conducting members are ceramic.

3. The sandwich panel of claim 1, wherein the heat conducting members are metallic.

4. The sandwich panel of claim 3 wherein the metallic heat conducting members have circular cross-section and contact the facing members at the periphery of the cross-section.

5. The sandwich panel of claim 4 wherein gas flow passageways are defined in part by a portion of the periphery of the heat conducting members spaced from a portion of the surface of the inner facing member, the passageways being disposed opposite the welds.

6. The sandwich panel of claim 1, wherein the ends of the inner facing member having distal portions are in contact with the heat conducting members and with the insulating material.

7. The sandwich panel of claim 6, wherein the distal end portions of the inner facing member have return bends extending into the insulating material and contacting the heat conducting members.

8. The sandwich panel of claim 6, and wherein the heat conducting members are themselves fixedly attached to the inner facing member.

9. The sandwich panel of claim 8, wherein the distal end portions of the inner facing member are in slidable contact with the heat conducting members.

10. The sandwich panel of claim 9, wherein the heat conducting members have a thickness at least about equal to the thickness of the inner facing member they contact, whereby the heat conducting members reinforce the facing member against warping.

11. The sandwich panel of claim 10, wherein the heat conducting members are of metallic material and are welded to the inner facing member.

12. An assembly of sandwich panels arranged in abutting end-to-end relationship, the assembly generally defining a chamber for maintaining the space enclosed by the chamber at a temperature, at least one sandwich panel having:

an inner metallic facing member having ends and an opposed spaced apart metallic facing member, the ends of the inner facing member having distal portions extending toward the opposed spaced apart metallic facing member, with welds joining the ends to the abutting sandwich panels; and a thermal insulating organic material having a thermal conductivity of less than about 0.3 Btu/hr, ft$^2$, ° F./ft generally filling the space between the sandwich panel facing members, the insulating material being adhesively bonded to the facing members, the insulating material being in contact with the distal end portions of the inner facing member; and comprising:

metallic heat conducting members having a thermal conductivity of greater than about 0.3 Btu/hr, ft$^2$, ° F./ft disposed in the insulating material, welded to the inner facing member adjacent to the welds with the abutting sandwich panels, the welds with the abutting sandwich panels being disposed between the distal end portions and the welds with the heat conducting members, the heat conducting members being in slidable contact with the distal portions of the ends.

13. The assembly of claim 12, wherein the heat conducting members have thicknesses at least equal to the thicknesses of the facing member they contact, and also contact the distal end portions whereby the heat conducting members reinforce the inner facing members against warping and urge the distal end portions toward the adjacent distal end portions during welding.

14. The assembly of claim 13, comprising at least two abutting sandwich panels joined by a weld, each sandwich panel having a heat conducting member adjacent the weld, wherein the heat conducting members have different cross sectional shapes.

15. The assembly of claim 14, wherein one heat conducting member has a circular cross-sectional shape and the other heat conducting member has a flat surface contacting the inner facing member.

16. The assembly of claim 12, wherein a silicone coating is disposed on the heat conducting members and on the adjacent distal end portions for thermally protecting the insulating material and facilitating relative thermal expansion of the metallic members during welding.

* * * * *